US009982908B2

(12) United States Patent
Yoshitake et al.

(10) Patent No.: US 9,982,908 B2
(45) Date of Patent: May 29, 2018

(54) AIR CONDITIONER

(71) Applicant: Toshiba Carrier Corporation, Kawasaki-shi, Kanagawa (JP)

(72) Inventors: Nobusato Yoshitake, Fuji (JP); Kenji Gajina, Fuji (JP)

(73) Assignee: TOSHIBA CARRIER CORPORATION, Kawasaki-shi (JP)

( * ) Notice: Subject to any disclaimer, the term of this patent is extended or adjusted under 35 U.S.C. 154(b) by 0 days. days.

(21) Appl. No.: 15/239,595

(22) Filed: Aug. 17, 2016

(65) Prior Publication Data

US 2016/0356524 A1 Dec. 8, 2016

Related U.S. Application Data

(63) Continuation of application No. PCT/JP2015/053682, filed on Feb. 10, 2015.

(30) Foreign Application Priority Data

Feb. 18, 2014 (JP) ..... 2014-028677

(51) Int. Cl.
*F25D 21/14* (2006.01)
*F24F 13/22* (2006.01)
(Continued)

(52) U.S. Cl.
CPC ..... *F24F 13/222* (2013.01); *F24F 1/0007* (2013.01); *F24F 1/0014* (2013.01);
(Continued)

(58) Field of Classification Search
CPC ..... F24F 13/222; F24F 13/20; F24F 13/32; F24F 1/0007; F24F 1/0014; F24F 1/0022; F24F 2001/0037; F25D 21/14
(Continued)

(56) References Cited

U.S. PATENT DOCUMENTS

2010/0192610 A1* 8/2010 Yoshitake ..... F24F 1/0007 62/291

FOREIGN PATENT DOCUMENTS

EP 2 023 049 A2 2/2009
EP 2 199 701 A1 6/2010
(Continued)

OTHER PUBLICATIONS

JP2003336893 machine translation.*
(Continued)

*Primary Examiner* — Joseph Trpisovsky
(74) *Attorney, Agent, or Firm* — John P. White; Cooper & Dunham LLP

(57) ABSTRACT

According to one embodiment, a ceiling-embedded air conditioner includes a main body incorporating a heat exchanger, a decorative panel attached to a lower edge of the main body and including a discharge port discharging air heat-exchanged in the heat exchanger to a room, and a drain pan including a thermal insulating member and a synthetic resin member coating the thermal insulating member. The drain pan includes a recess for receiving drain water produced in the heat exchanger, a communication port provided on a periphery of the recess and communicating with the discharge port of the decorative panel, and a wall standing between the periphery of the recess and the communication port. The wall is composed of the synthetic resin member.

9 Claims, 10 Drawing Sheets

(51) Int. Cl.

| | |
|---|---|
| ***F24F 13/32*** | (2006.01) |
| ***F24F 1/00*** | (2011.01) |
| ***F24F 13/20*** | (2006.01) |

(52) U.S. Cl.
CPC ..... *F24F 1/0022* (2013.01); *F24F 13/20* (2013.01); *F24F 13/32* (2013.01); *F24F 2001/0037* (2013.01)

(58) Field of Classification Search
USPC ..... 62/291
See application file for complete search history.

(56) References Cited

FOREIGN PATENT DOCUMENTS

| | | |
|---|---|---|
| GB | 2 314 924 | 1/1998 |
| JP | 57-60023 | 4/1982 |
| JP | 2000-320888 | 11/2000 |
| JP | 2002-349892 | 12/2002 |
| JP | 2003-336893 | 11/2003 |
| JP | 2004-085000 | 3/2004 |
| JP | 2008-151497 | 7/2008 |
| JP | 2009-115360 | 5/2009 |

OTHER PUBLICATIONS

International Search Report in connection with PCT International Application No. PCT/JP2015/053682.
Preliminary Report on Patentability in connection with PCT International Application No. PCT/JP2015/053682.
Written Opinion of the International Searching Authority in connection with PCT International Application No. PCT/JP2015/053682.
Extended European search report dated Nov. 8, 2017 in corresponding European patent application 15751287.2.

* cited by examiner

AIR CONDITIONER

CROSS-REFERENCE TO RELATED APPLICATIONS

This application is a Continuation Application of PCT Application No. PCT/JP2015/053682, filed Feb. 10, 2015 and based upon and claiming the benefit of priority from Japanese Patent Application No. 2014-028677, filed Feb. 18, 2014, the entire contents of all of which are incorporated herein by reference.

FIELD

Embodiments described herein relate generally to a ceiling-embedded air conditioner comprising a drain pan which receives drain water produced in a heat exchanger.

BACKGROUND

A ceiling-embedded air conditioner comprises a main body installed in a ceiling. The main body incorporates a blower and a heat exchanger and comprises an intake port at its lower edge. The intake port is covered with a rectangular decorative panel. The decorative panel is exposed to the inside of a room through the ceiling and comprises a plurality of discharge ports.

When the blower is driven, the blower draws air from the room into the main body through the intake port. After the blower draws the air into the main body, the heat exchanger exchanges heat between the air and a refrigerant while the air passes through the heat exchanger. The heat-exchanged air is then discharged as cool air or warm air into the room through the discharge ports.

In an ordinary air conditioner, an intake grille is provided in the center of the decorative panel. The intake grille has a square shape with four sides and is opposed to the intake port of the main body. Further, the discharge ports of the decorative panel are long thin openings which extend along the respective sides of the intake grille.

In a conventional air conditioner, a drain pan is provided under the heat exchanger. The drain pan is an element which receives drain water produced in association with the heat exchange operation of the heat exchanger and includes a recess in which the lower edge of the heat exchanger is fitted. The drain pan is composed of a thermal insulating member formed of a foamed plastics material such as a foamed polystyrene material and a resin sheet member coating the surface of the thermal insulating member.

Further, the drain pan comprises a plurality of communication ports which communicate with the discharge ports. The communication port has a long thin shape conforming to the shape of the discharge port and is located on the periphery of the recess. The peripheral wall of the drain pan which defines the communication port is composed of the thermal insulating member and the resin sheet member, and the resin sheet member is exposed to the communication port.

Since the communication port of the drain pan is located in the upper stream of the discharge port, the area of the opening of the communication port has a great effect on the ventilation resistance to the air discharged into the room and the air-discharge performance of the air conditioner. Therefore, there is demand for a ceiling-embedded air conditioner which can improve the air-discharge performance by increasing the area of the opening of the communication port of the drain pan and decreasing the ventilation resistance to the air discharged into the room through the discharge port.

DETAILED DESCRIPTION

Embodiments of the present invention will be described below with reference to the accompanying drawings.

In general, according to one embodiment, an air conditioner comprises a main body incorporating a heat exchanger installed in a ceiling, a decorative panel attached to a lower edge of the main body, exposed to a room through the ceiling, and including a discharge port discharging air heat-exchanged in the heat exchanger into the room, and a drain pan composed of a thermal insulating member and a synthetic resin member coating the thermal insulating member.

The drain pan comprises a recess receiving drain water produced in the heat exchanger, a communication port provided on a periphery of the recess and communicating with the discharge port of the decorative panel, and a wall standing between the periphery of the recess and the communication port, the wall is composed of the synthetic resin member.

Figure 1:
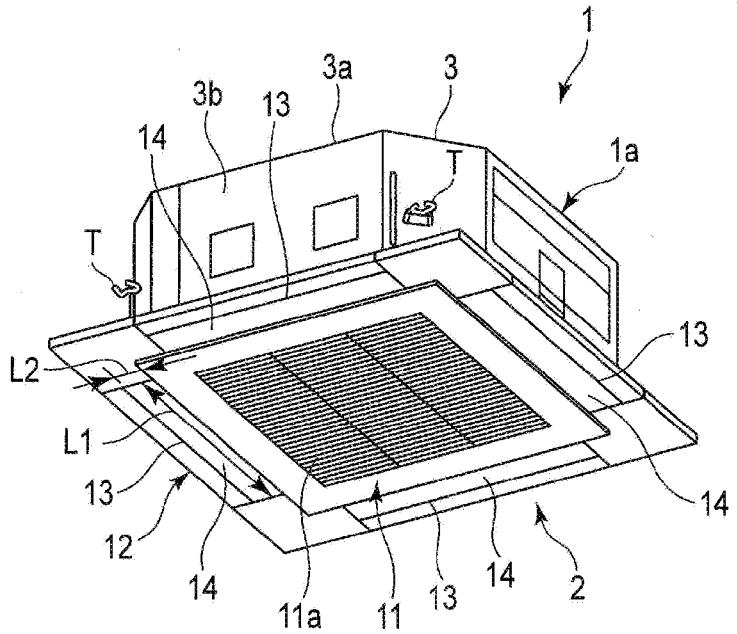
FIG. 1 is a perspective view of a ceiling-embedded air conditioner.
Figure 2:
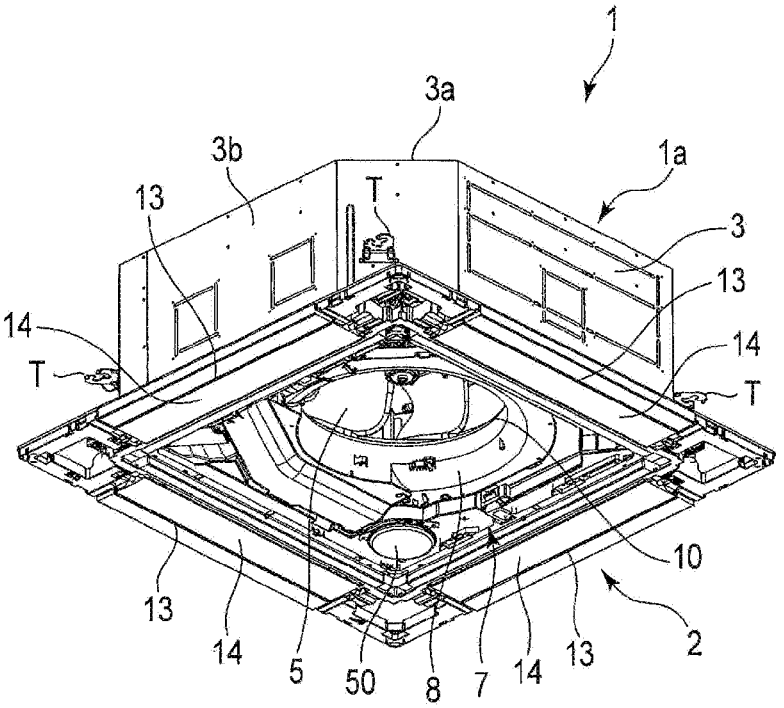
FIG. 2 is a perspective view of the air conditioner in which a decorative panel is detached from the main body.
Figure 3:
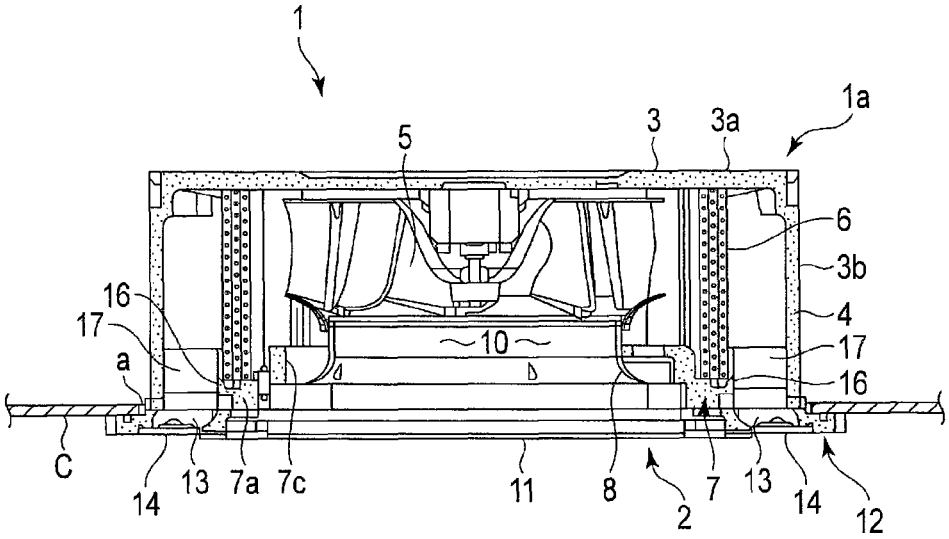
FIG. 3 is a sectional view of the ceiling-embedded air conditioner.

FIG. 1 is a perspective view of a ceiling-embedded air conditioner, FIG. 2 is a perspective view of the air conditioner where a decorative panel is detached from the main body, and FIG. 3 is a sectional view of the ceiling-embedded air conditioner.

As shown in FIGS. 1 to 3, an air conditioner 1 mainly comprises a main body 1*a* installed in a ceiling and a decorative panel 2 attached to the lower edge of the main body 1*a*. The main body 1*a* is installed through an opening a formed in a ceiling board C and is hung from a beam of the ceiling via a plurality of hanging bolts (not shown).

The main body 1*a* comprises a sheet-metal casing 3. The casing 3 is a downward-opening box-like element and has a top panel 3*a* and side surfaces 3*b* formed through metal sheet processing. The side surfaces 3*b* of the casing 3 include four corners, and the metal hangers T are fixed to the respective corners. The metal hangers T are connected to the lower edges of the hanging bolts and project horizontally from the side surfaces 3*b*. Further, the inner periphery of the casing 3 is covered with a thermal insulating member 4 such as a foamed polystyrene member. Therefore, the main body 1*a* has a heat insulating structure.

A blower 5 is provided in about the center of the main body 1*a*. In the embodiment, a centrifugal fan which draws air axially and then discharges the air circumferentially is used as the blower 5. Since the upper edge of the blower 5 is covered with the top panel 3*a* of the casing 3*a*, the lower edge of the blower 5 is the intake side.

A heat exchanger 6 is provided around the discharge side of the blower 5. The heat exchanger 6 has a substantially rectangular frame shape and surrounds the blower 5. A drain pan 7 is provided along the lower portion of the heat exchanger 6. The drain pan 7 receives drain water produced by the heat exchange operation of the heat exchanger 6 when the air conditioner 1 is operated in a cooling mode. The drain water collected in the drain pan 7 is drained out of the air conditioner 1 by a drain pump 49 shown in FIG. 12.

A circular installation hole 7*c* is formed in the center of the drain pan 7. A bell mouth 8 is installed in the installation hole 7*c* of the drain pan 7. The bell mouth 8 constitutes an intake port 10 opposed to the intake side of the blower 5.

As shown in FIGS. 2 and 3, the drain pan 7 is located at the lower edge of the downward-opening casing 3. The outer periphery of the drain pan 7 is fitted in the thermal insulating member 4 which covers the inner periphery of the casing 3.

The decorative panel 2 covers the lower edge of the casing 3 from the room side. The decorative panel 2 is formed of, for example, a synthetic resin member and is attractively designed. The decorative panel 2 is exposed to the room thorough the lower surface of the ceiling board C and is closing a gap between the outer periphery of the main body 1*a* and the opening a of the ceiling board C.

As shown in FIG. 1, the decorative panel 2 comprises an intake grille 11 and a panel main body 12. The intake grille 11 is provided in about the center of the decorative panel 2. The intake grille 11 has a square shape and is, for example, detachably supported on the casing 3 via a vertically movable mechanism or a rotatable mechanism.

The intake grille 11 comprises a periphery in a rectangular frame shape and a grille part 11*a* surrounded by the periphery. The periphery is defined by four sides, and the four sides are long thin plates having a predetermined width. The grille part 11*a* is located in the center of the intake grille 11. The grille part 11*a* is opposed to the intake port 10. A filter (not shown) is detachably supported on the backside of the grille part 11*a*.

As shown in FIG. 1, the panel main body 12 of the decorative panel 2 is in a rectangular frame shape with four sides and is connected to the casing 3. The panel main body 12 continuously surrounds the periphery of the intake grille 11.

Further, the panel main body 12 comprises four discharge ports 13. The discharge ports 13 are elements which discharge the air heat-exchanged in the heat exchanger 6 in four directions and are provided in the four sides of the panel main body 12. The discharge ports 13 are long thin openings extending respectively along the periphery of the intake grille 11. More specifically, the discharge port 13 has a first dimension L1 in the longitudinal direction of the discharge port 13 and a second dimension L2 in the lateral direction of the discharge port 13, and the second dimension L2 is much less than the first dimension L1.

Figure 5:
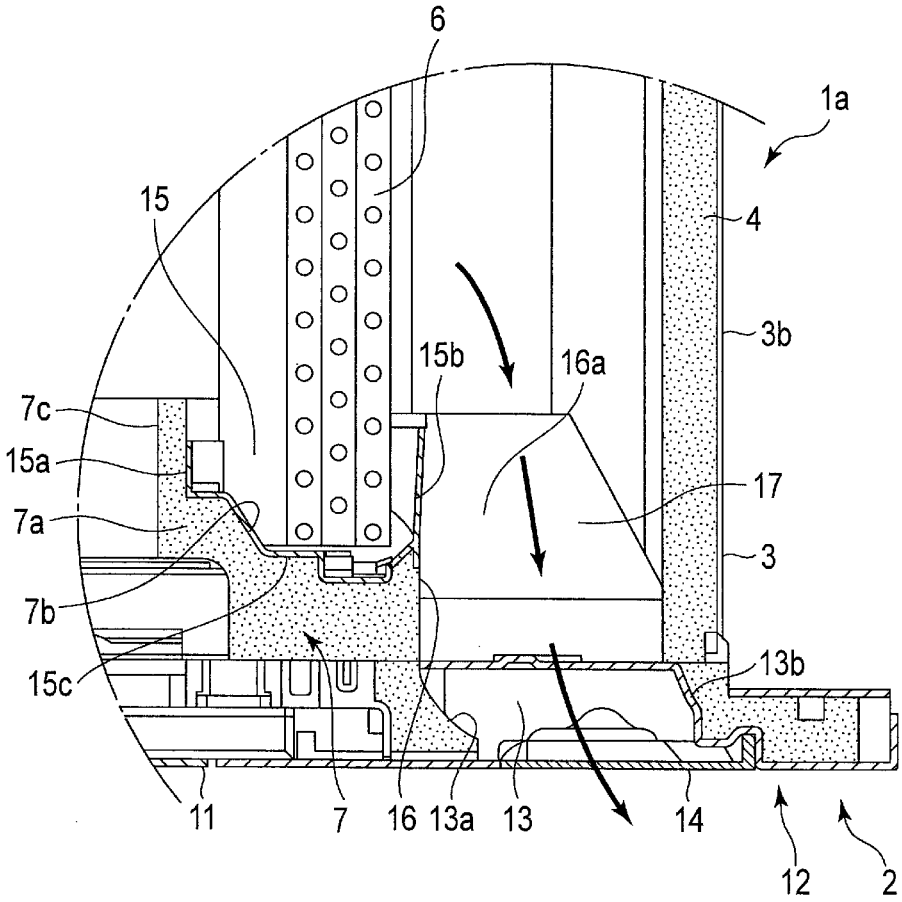
FIG. 5 is a sectional view of the air conditioner showing the positional relationships among a heat exchanger, a communication port of the drain pan and a discharge port of the decorative panel.

As shown in FIG. 5, the discharge port 13 comprises an inner sidewall 13*a* and an outer sidewall 13*b*. The inner sidewall 13*a* constitutes the inner side surface of the discharge port 13 extending along the longitudinal direction of the discharge port 13. Similarly, the outer sidewall 13*b* constitutes the inner side surface of the discharge port 13 extending along the longitudinal direction of the discharge port 13. As extending downward, the inner sidewall 13*a* and the outer sidewall 13*b* incline toward the outer periphery of the panel main body 12.

In the four discharge ports 13 of the panel main body 12, flaps 14 are provided, respectively. The flap 14 is an element which changes the direction of air discharged from the discharge port 13 into the room, and is rotatably supported on the panel main body 12. The flap 14 has a long thin flat plate shape conforming to the shape of the opening of the discharge port 13 and has such a size as to be neatly fitted in the discharge port 13.

When the air conditioner 1 is not in operation, the flaps 14 completely close the discharge ports 13. Therefore, the inside of the main body 1*a* will not be exposed to the outside through the discharge ports 13, and thus the excellent appearance of the air conditioner 1 can be maintained.

When the air conditioner 1 starts operation, the flaps 14 rotate at a desired angle inside the discharge ports 13 and the discharge ports 13 become open. At the same time, the blower 5 is driven to draw air from the room into the main body 1*a* through the intake grille 11.

After the blower 5 draws air into the main body 1*a*, the heat exchanger 6 exchange heat between the air and the refrigerant while the air passes through the heat exchanger 6. The heat-exchanged air is then guided from the discharge ports 13 to the flaps 14 and discharged into the room to cool or warm the room.

Next, the structure of the drain pan 7 will be described.

Figure 4:
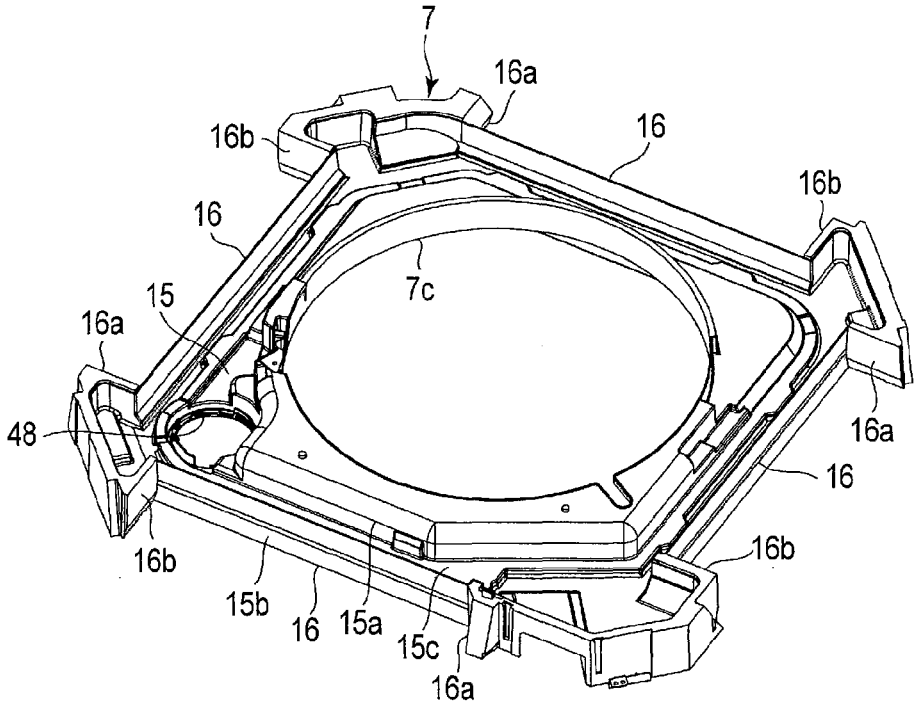
FIG. 4 is a perspective view of a drain pan which receives drain water.

FIG. 4 is a perspective view of the drain pan, FIG. 5 is a sectional view of the air conditioner showing the positional relationships among the heat exchanger, the drain pan, and the discharge port of the decorative panel. The drain pan 7 is composed of a thermal insulating member 7*a* and a synthetic resin member 7*b* coating the surface of the thermal insulating member 7*a*. The thermal insulating member 7*a* is an element defining the shape of the drain pan 7 and is formed of, for example, a foamed plastics material such as a foamed polystyrene material. The synthetic resin member 7*b* is, for example, a resin sheet member having a thickness of about 5 mm. The resin sheet member has some degree of rigidity and is significantly thinner than the thermal insulating member 7*a*.

As shown in FIGS. 4 and 5, the drain pan 7 has a rectangular frame shape corresponding to the shape of the heat exchanger 6, and comprises four peripheral edges surrounding the installation hole 7*c* in which the bell mouth 8 is installed. In the peripheral edges of the drain pan 7, there are a recess 15 in which the lower edge of the heat exchanger 6 is fitted and four notches 16 to which the air having passed thorough the heat exchanger 6 is guided.

The recess 15 has an inner sidewall 15*a*, an outer sidewall 15*b* and a bottom wall 15*c*, and is formed continuously along the periphery of the drain pan 7. As most clearly shown in FIG. 5, the inner sidewall 15*a* and the bottom wall 15*c* of the recess 15 are composed of the thermal insulating member 7*a* and the synthetic resin member 7*b*. In the portion corresponding to the outer sidewall 15*b* of the recess 15, the thermal insulating member 7*a* is removed. Therefore, the outer sidewall 15*b* is composed of the sheet-like synthetic resin member 7*b* having some degree of rigidity.

The notches 16 of the drain pan 7 are formed outside of the recess 15 in a long thin shape extending along the respective peripheral edges of the drain pan 7. The notches 16 are separated from the recess 15 by the outer sidewall 15*b* of the recess 15. In other words, the sheet-like outer sidewall 15*b* stands between the recess 15 and the notches 16.

Further, each notch 16 has a pair of end walls 16*a* and 16*b* separated from each other along the longitudinal direction of the notch 16. The end walls 16*a* and 16*b* extend along the lateral direction of the notch 16 and project from both ends of the longitudinal outer sidewall 15*b* toward the thermal insulating member 4 covering the inner periphery of the casing 3. As in the case of the inner sidewall 15*a* and the bottom wall 15*c* of the recess 15, the end walls 16*a* and 16*b* are composed of the thermal insulating member 7*a* and the synthetic resin member 7*b*.

As described above, the outer periphery of the drain pan 7 is fitted in the thermal insulating member 4 which covers the inner periphery of the casing 3. Therefore, the notches 16 of the drain pan 7 constitute communication ports 17 in conjunction with the thermal insulating member 4. The communication port 17 has an opening in about the same shape as that of the discharge port 13 of the intake grille 11 and communicates with the discharge port 13.

As a result, the air having passed through the heat exchanger 6 is, as indicated by the arrow in FIG. 5, guided into the discharge port 13 of the decorative panel 2 from between the heat exchanger 6 and the thermal insulating member 4 of the main body 1*a* through the communication port 17.

According to the present embodiment, except for the outer sidewall 15*b* at the boundary with the discharge port 13, the recess 15 of the drain pan 7 is composed of the thermal insulating member 7*a* and the sheet-like synthetic resin member 7*b* coating the surface of the thermal insulating member 7*a*. Therefore, the insulating efficiency of the recess 15 is maintained.

More specifically, the recess 15 of the drain pan 7 receives drain water produced in the heat exchanger 6 when the air conditioner 1 is in operation. Since the insulating efficiency is maintained in the recess 15 as described above, even if cold drain water is collected in the recess 15 of the drain pan 7, condensation will not occur on the outer periphery of the drain pan 7.

On the other hand, in a conventional air conditioner, a drain pan is composed of a foamed polystyrene thermal insulating member and a sheet-like thermal insulating member coating with the thermal insulating member. Further, the outer sidewall of the drain pan at the boundary with notches defining communication ports also mainly comprises the thermal insulating member. In addition, there is no difference in the external dimensions of the drain pan to be fitted in a thermal insulating member of a casing, the position of a recess in which the lower edge of a heat exchanger is fitted, and the dimensions of the recess, from the present embodiment.

As a result, because the outer sidewall comprises the thermal insulating member, the thickness of the outer sidewall of the drain pan at the boundary between the recess and the communication port inevitably increases, and thus the lateral dimension of the communication port is restricted. Further, since both ends of the respective communication ports extend up to the four corners of the decorative panel, it is impossible to increase the longitudinal dimension of the communication ports any more. Similarly, since the outer periphery of the drain pan is fitted in the casing, the lateral dimension of the communication port is restricted by the casing.

Therefore, in the conventional air conditioner, the longitudinal and lateral dimensions of the communication port of the drain pan are restricted, and thus the area of the opening of the communication port has already reached its limit. Consequently, the amount of air to be actually discharged from the discharge port to the room will be reduced by the ventilation resistance produced against the heat-exchanged air passing through the communication port.

In the present embodiment, the recess 15 of the drain pan 7 which receives drain water produced in the heat exchanger 6 has the inner sidewall 15*a*, the outer sidewall 15*b* and the bottom wall 15*c*. Therefore, as long as at least the inner sidewall 15*a* and the bottom wall 15*c* comprise the thermal insulating member 7*a* coated with the sheet-like synthetic resin member 7*b*, the insulating efficiency of the drain pan 7 will be maintained.

In the present embodiment, the thermal insulating member 7*a* in the portion corresponding to the outer sidewall 15*b* of the recess 15 is removed, and the outer sidewall 15*b* is composed of the sheet-like synthetic resin member 7*b*. Therefore, the thickness of the outer sidewall 15*b* at the boundary between the recess 15 and the communication port 17 can be reduced as much as possible, and thus the lateral dimension of the communication port 17 can be increased.

Consequently, it becomes possible to increase the area of the opening of the communication port 17 and the area of the opening of the discharge port 13 and to reduce the ventilation resistance to the air heat-exchanged in the heat exchanger 6 and thereby increase the amount of air discharged from the discharge port 13 to the room.

In the present embodiment, the drain pan 7 fitted in the lower edge of the casing 3 comprises a pair of engagement portions 20 which temporarily fixes the decorative panel 2 to the casing 3 when the air conditioner 1 is assembled.

Figure 6:
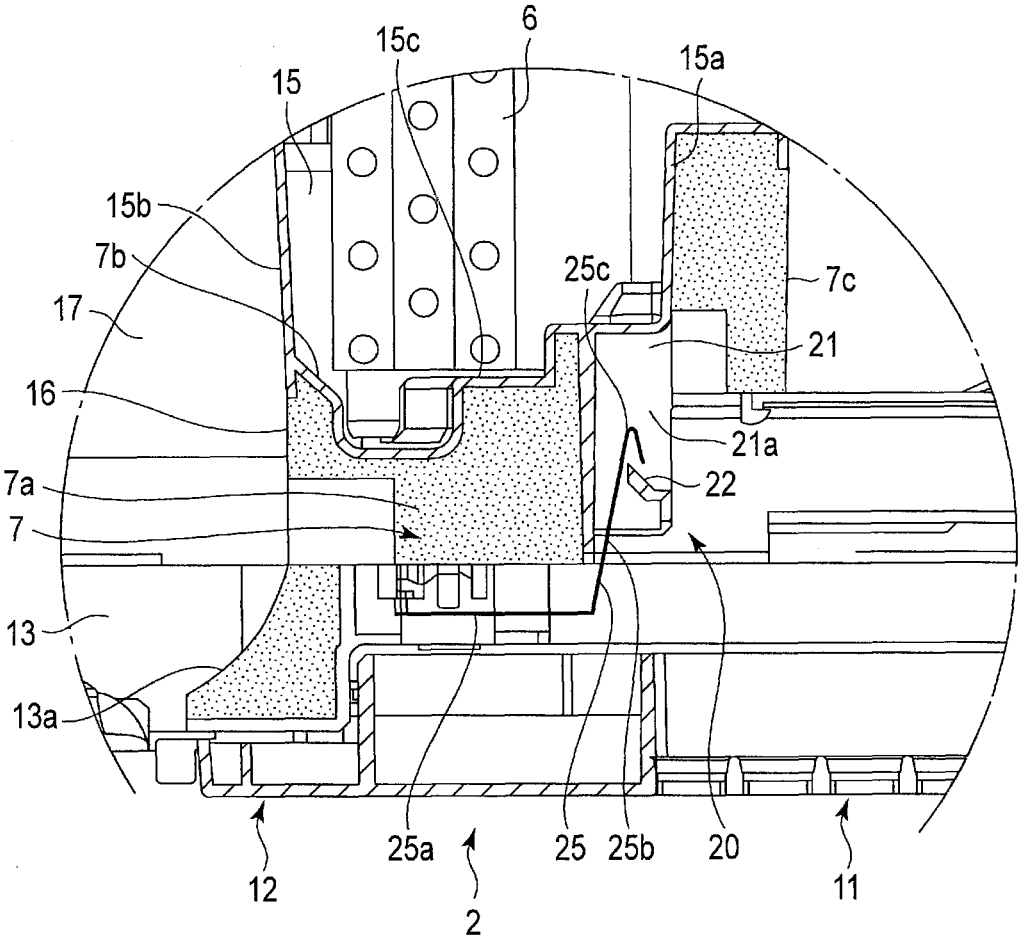
FIG. 6 is a sectional view of the air conditioner showing the positional relationship between a holder of the decorative panel and an engagement portion of the drain pan.
Figure 7A:
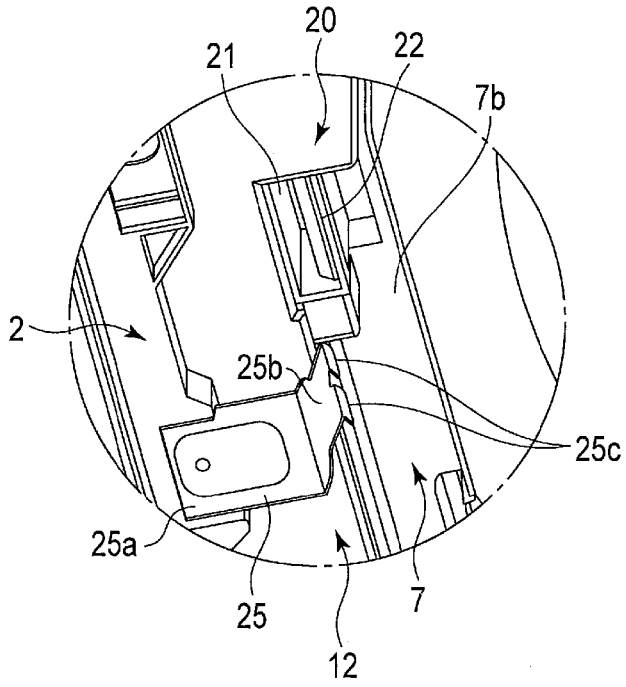
FIG. 7A is a sectional diagram showing a state where the holder of the decorative panel is unhooked from the engagement portion of the drain pan.
Figure 7B:
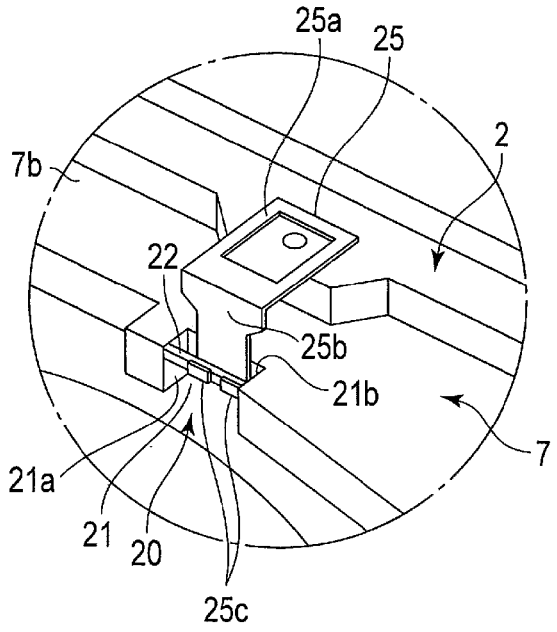
FIG. 7B is a sectional diagram showing a state where the holder of the decorative panel is hooked on the engagement portion of the drain pan.
Figure 8:
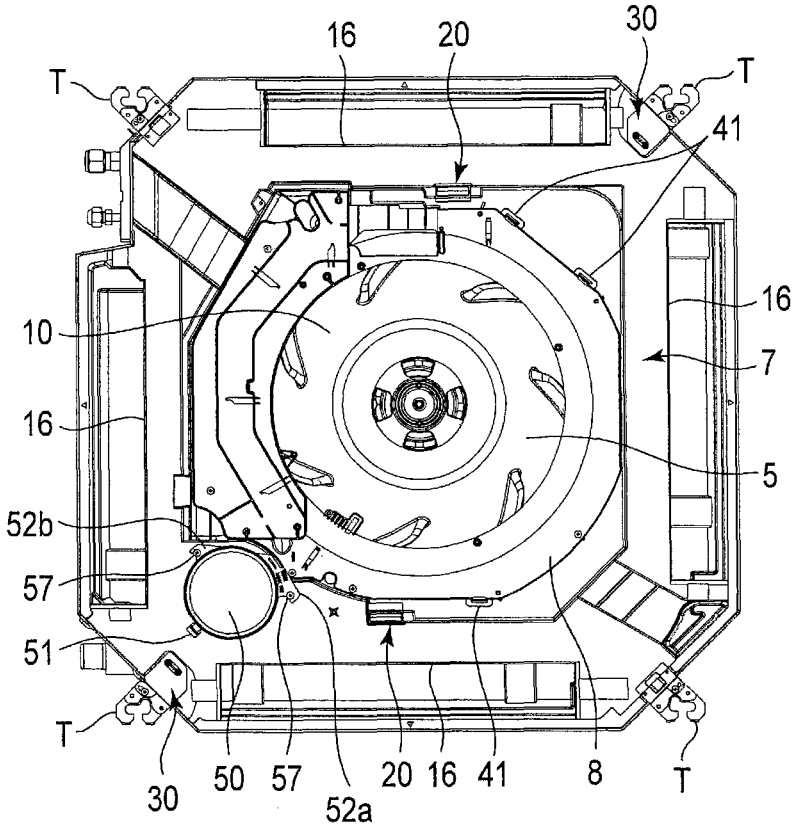
FIG. 8 is a bottom plan view of the air conditioner in which the decorative panel is detached from the main body.

FIG. 6 is a sectional view of the air conditioner showing the positional relationship between a holder of the decorative panel and the engagement portion of the drain pan, FIG. 7A is a sectional diagram showing a state where the holder of the decorative panel is unhooked from the engagement portion of the drain pan, FIG. 7B is a perspective diagram showing a state where the holder of the decorative panel is hooked on the engagement portion of the drain pan, and FIG. 8 is a bottom plan view of the air conditioner in which the decorative panel is detached from the main body.

As shown in FIG. 8, the pair of the engagement portions 20 is opposed to each other via the intake port 10 as the air conditioner 1 is viewed from the direction of the decorative panel 2. Each engagement portion 20 is integrally formed with the synthetic resin member 7*b* which constitutes the drain pan 7.

As shown in FIGS. 6, 7A and 7B, each engagement portion 20 comprises a recess 21 and a bridge 22. The recess 21 comprises a pair of sidewalls 21*a* and 21*b*. The sidewalls 21*a* and 21*b* are opposed to each other with a gap therebetween along the longitudinal direction of the peripheral edge of the drain pan 7. The bridge 22 bridges between the sidewalls 21*a* and 21*b* along the longitudinal direction of the peripheral edge of the drain pan 7.

A pair of holders 25 (only one of which is shown) is attached to the panel main body 12 of the decorative panel 2. The holder 25 is, for example, a thin metal plate. As shown in FIGS. 7A and 7B, the holder 25 comprises a base portion 25*a* fixed to the upper surface of the panel main body 12 with a fastening member such as a screw, and an extension portion 25*b* formed at one end of the base portion 25*a* where the base portion 25*a* is bent upward at a right angle. At the upper end of the extension portion 25*b*, a pair of claw portions 25*c* where the extension portion 25*b* is bent in an arc-like manner is formed.

In installing the decorative panel 2 in the main body 1*a*, the holders 25 are attached to two positions of the upper surface of the panel main body 12 of the decorative panel 2 in advance. The two positions of the upper surface of the panel main body 12 are the positions corresponding to the pair of engagement portions 20 provided in the drain pan V. The decorative panel 2 provided with the holders 25 is then installed in a predetermined position of the main body 1*a* such that the decorative panel 2 covers the lower edge of the casing 3 from the room side via the drain pan 7 fitted in the casing 3.

At this time, the extension portion 25*b* of the holder 25 projecting from the upper surface of the decorative panel 2 is inserted into the recess 21 of the drain pan 7, and the claw portions 25*c* of the holder 25 are hooked on the bridge 22. In this way, the decorative panel 2 is temporarily fixed to the main body 1*a*.

In a conventional air conditioner, to temporarily fix a decorative panel to the main body, a metal member on which a holder attached to the decorative panel is hooked is formed in a drain pan by insert molding. Therefore, a metal member to be inserted is required separately, and this leads to an increase in the cost of the drain pan as well as an increase in the manufacturing time of the drain pan.

In the present embodiment, the decorative panel 2 is temporarily fixed to the main body 1*a* mostly when the decorative panel 2 is attached to the main body 1 or the decorative panel 2 is removed from the main body 1*a*, and thus the decorative panel 2 is not always in a temporarily fixed state. Therefore, even if an element on which the claw portions 25*c* of the holder 25 are hooked is not formed of a metal member by insert molding, there is no problem in the strength of the element.

In the present embodiment, the engagement portion 20 on which the claw portions 25*c* of the holder 25 are hooked is formed integrally with the sheet-like synthetic resin member 7*b* which constitutes the drain pan 7. Therefore, it is no longer necessary to form a metal member by insert molding, and thus it is possible to reduce the cost of the drain pan 7.

The outer periphery of the drain pan 7 is fitted in the lower edge of the casing 3. Therefore, it is preferable that the drain pan 7 should be easily detachable from the casing 3 or easily attachable to the casing 3 to improve the service performance of the maintenance and inspection work of the air conditioner 1.

In the present embodiment, the drain pan 7 is detachably supported on the casing 3 via a pair of metal fixtures 30 shown in FIG. 8. The pair of fixtures 30 is attached diagonally to the side surfaces 3*b* of the casing 3.

Figure 9A:
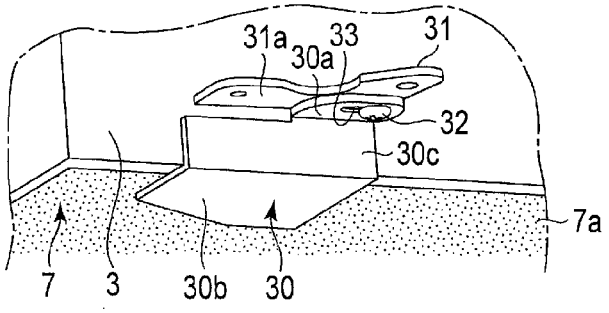
FIG. 9A is a perspective diagram showing a state where the drain pan is attached to a casing of the main body with a fixture.
Figure 9B:
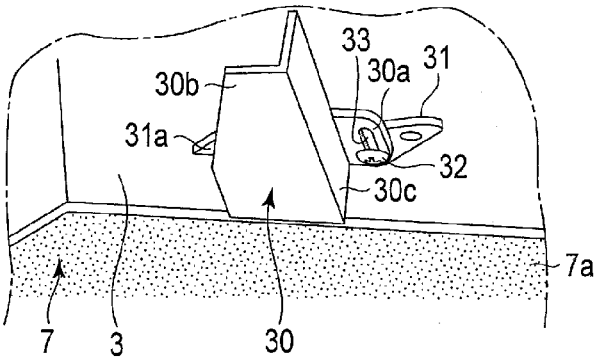
FIG. 9B is a perspective diagram showing a state where the fixture is rotated away from the drain pan.

FIG. 9A is a perspective diagram showing a state where the drain pan 7 is attached to the casing 3 with the fixture 30, and FIG. 9B is a perspective diagram showing a state where the fixture 30 is rotated away from the drain pan 7. As shown in FIGS. 9A and 9B, each fixture 30 is attached to a metal support 31 fixed to the side surface 3*b* of the casing 3 via a screw 32. The screw 32 is an example of a fastening member.

More specifically, the metal support 31 comprises a flat-plate receiving portion 31*a*. The receiving portion 31*a* projects from the side surface 3*b* of the casing 3 horizontally at the periphery of the casing 3. In a part of the receiving portion 31*a*, a screw hole 31*b* into which the screw 32 is driven is formed.

On the other hand, each fixture 30 comprises a first surface 30*a*, a second surface 30*b*, and an intermediate portion 30*c*. The first surface 30*a* closely contacts the lower surface of the receiving portion 31*a* of the metal support 31 and extends horizontally. The second surface 30*b* closely contacts the lower edge of the casing 3 and the lower surface of the drain pan 7 and extends horizontally in a direction opposite to that of the first surface 30*a*. The intermediate portion 30*c* connects the first surface 30*a* and the second surface 30*b* and extends vertically to face the side surface 3*b* of the casing 3. Further, a long hole 33 overlapping the screw hole 31*b* is formed in the first surface 30*a*.

Figure 10:
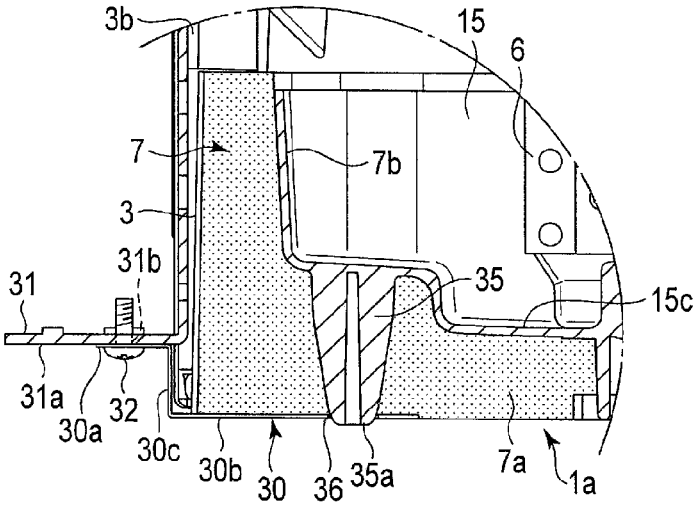
FIG. 10 is a sectional view of the air conditioner showing a state where a boss of the drain pan is fitted to the fixture.

To hold the drain pan 7 fitted in the lower edge of the casing 3 to the casing 3, as shown in FIGS. 9A and 10, the intermediate portion 30*c* of the fixture 30 is rotated to face the side surface 3*b* of the casing 3. Further, the first surface 30*a* of the fixture 30 is brought into contact with the lower surface of the receiving portion 31*a* of the metal support 31, and the second surface 30*b* is brought into contact with the lower edge of the casing 3 and the lower surface of the drain pan 7. In this state, the screw 32 is driven into the screw hole 31*b* via the long hole 31.

In this way, the drain pan 7 is securely held to the lower edge of the casing 3 such that the drain pan 7 will not fall from the casing 3.

When it is necessary to detach the drain pan 7 from the casing 3 to perform maintenance and inspection of the air conditioner 1, the screw 32 is loosened and the fixture 30 is released. More specifically, it is possible, by loosening the screw 32, to rotate the fixture 30 away from the casing 3 and the drain pan 7 as shown in FIG. 9B. In the rotation of the fixture 30, the screw 32 serves as the rotation axis.

In the rotation of the fixture 30, if the first surface 30*a* and the intermediate portion 30*c* of the fixture 30 are blocked with the side surface 3*b* of the casing 3 and the rotation of the fixture 30 is thereby limited, the screw 32 is slid along the long hole 33. In other words, the positional relationship between the screw 32 and the long hole 33 is changed.

As a result, the fixture 30 is detached from the casing 3 and the drain pan 7 while being held on the metal support 31 with the screw 32. In this way, both the casing 3 and the drain pan 7 change from a fixed state to a free state, and the drain pan 7 can be detached from the lower edge of the casing 3.

When the maintenance and inspection of the air conditioner 1 is complete, the drain pan 7 is fitted in the lower edge of the casing 3. Then, the fixture 30 is rotated about the screw 32, and the second surface 30*b* of the fixture 30 is brought into contact with the lower edge of the casing 3 and the lower surface of the drain pan 7. That is, the fixture 30 is returned from the posture of FIG. 9B to the posture of FIG. 9A, and the screw 32 is tightened.

According to the present embodiment, it is possible to rotate the fixture 30 away from the drain pan 7 simply by loosening the screw 32 without detaching the screw 32. Further, it is possible to fix the fixture 30 to the predetermined position simply by tightening the screw 32 after bringing the second surface 30*b* of the fixture 30 into contact with the lower edge of the casing 3 and the lower surface of the drain pan 7.

Therefore, it is no longer necessary to detach the fixture 30 from the casing 3 and attach the fixture 30 to the casing 3, and thus it is possible to improve the service performance of the maintenance and inspection work of the air conditioner 1.

In the present embodiment, even though the sheet-metal casing 3 does not have a great rigidity, the weights of the heat exchanger 6 and the drain pan 7 are put on the casing 3. Further, as shown in FIG. 8, the casing 3 comprises the metal hangers T for hanging the main body 1*a* on the corresponding positions above the fixtures 30.

Therefore, the casing 3 may be deformed by the weights of the heat exchanger 6 and the drain pan 7 put on the casing 3. If the casing 3 is deformed and the positions of the hangers T are shifted accordingly, the hanging bolts extending from the beam of the ceiling cannot be connected to the hangers T. Therefore, the present embodiment adopts a structure which can prevent such deformation of the casing 3.

More specifically, FIG. 10 is a sectional view of the air conditioner 1 showing the positional relationship between the drain pan 7 and the fixture 30. As shown in FIG. 10, a boss 35 is formed integrally with a part of the synthetic resin member 7*b* coating the thermal insulating member 7*a* of the drain pan 7. The boss 35 projects downward from the bottom wall 15*c* of the recess 15 and penetrates the thermal insulating member 7*a*. An end 35*a* of the boss 35 slightly projects from the lower surface of the drain pan 7. In the example of FIG. 10, the boss 35 is a hollow boss, but the boss 35 has such a structure for manufacturing reasons and this structure does not have any advantage in achieving the technical effect of the boss 35.

Further, the fixture 30 comprises an engagement hole 36 which is formed in the second surface 30*b*. The engagement hole 36 engages with the end 35*a* of the boss 35 when the second surface 30*b* of the fixture 30 is brought into contact with the lower surface of the drain pan 7. As a result, the end 35*a* of the boss 35 engages with the engagement hole 36 of the fixture 30.

Since the fixture 30 is fixed to the metal support 31 of the casing 3 with the screw 32, it is possible, by engaging the end 35*a* of the boss 35 with the engagement hole 36 of the fixture 30, to accurately determine the positional relationship between the drain pan 7 and the casing 3 and the positional relationship between the drain pan 7 and the fixture 30.

Consequently, it is possible to prevent positional shifts of the casing 3 and the hangers T caused by the weights of the drain pan 7 and the heat exchanger 6. In other words, it is possible to improve the service performance of the detachment or attachment work of the drain pan 7 from or to the main body 1*a* without degrading the service performance of the installation work of the air conditioner 1 or the detachment work of the decorative panel 2 from the main body 1*a*.

In a conventional air conditioner, a bell mouth, which forms an intake port of the main body, is fixed to a plurality of bosses provided in a synthetic resin member constituting a drain pan with screws. In a ceiling-embedded air conditioner, since an intake port has a large diameter, a bell mouth will inevitably be large. Therefore, a large number of bosses and screws are required to support the large, heavy bell mouth, and much time and effort is required to fix the bell mouth to the drain pan.

Figure 11A:
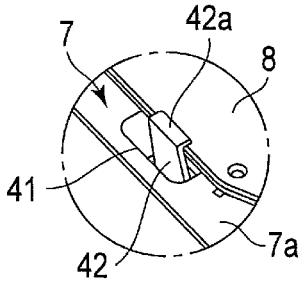
FIG. 11A is a perspective diagram showing an attachment structure for attaching a bell mouth to the drain pan.
Figure 11B:
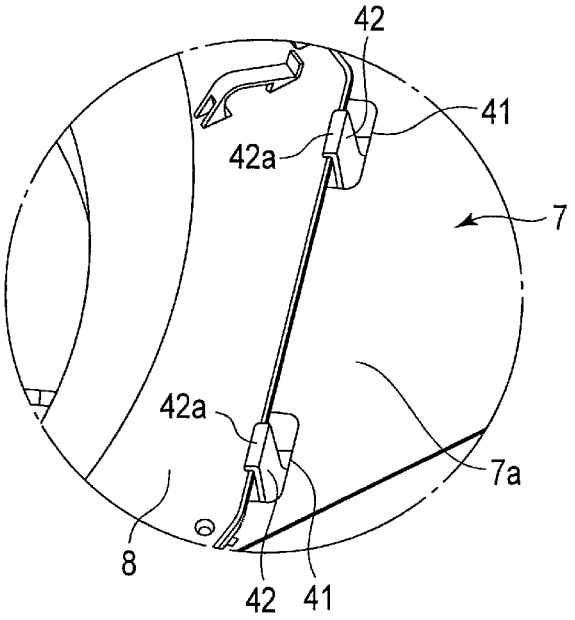
FIG. 11B is another perspective diagram showing the attachment structure for attaching the bell mouth to the drain pan.

To solve this problem, the present embodiment adopts a structure for easily fixing the bell mouth 8 to the drain pan 7. FIGS. 11A and 11B are perspective diagrams each showing an attachment structure for attaching the bell mouth 8 to the drain pan 7 upside down. The bell mouth 8 is fitted in the installation hole 7*c* of the drain pan 7 from below.

As shown in FIGS. 11A and 11B, a plurality of notches 41 are provided in the thermal insulating member 7*a* constituting the drain pan 7. The notches 41 are open to the installation hole 7*c* and are formed separately from each other along the circumference of the installation hole 7*c*.

Further, a plurality of engagement claws 42 are formed in the synthetic resin member 7*b* covering the upper surface of the thermal insulating member 7*a*. The engagement claw 42 is inserted in the notch 41. The end of the engagement claw 42 projects below the drain pan 7 through the notch 41. At the end of the engagement claw 42, a claw portion 42*a* projecting inward along the diameter direction of the installation hole 7*c* is formed. The claw portion 42*a* is hooked on the circumference of the bell mouth 8.

If the drain pan 7 in the upside-down state shown in FIGS. 11A and 11B is turned upside up, the claw portion 42*a* of the engagement claw 42 changes to the state of holding the circumference of the bell mouth 8 from below, and the bell mouth 8 is supported in the installation hole 7*c* of the drain pan 7.

Therefore, it is possible, by using the engagement claws 42 together with screws in the structure for attaching the bell mouth 8 to the drain pan 7, to reduce the number of the screws and the number of the screw support bosses. Consequently, it is possible to make fixing the bell mouth 8 to the drain pan 7 less troublesome.

In a conventional air conditioner, the drain pan has a drain outlet. The drain outlet is located directly below a drain pump which actively drains water collected in the drain pan. Further, the drain outlet is closed with a detachable drain cap. The drain cap is attached to the drain pan such that the circumference of the drain cap is secured to the drain pan with a large number of screws. In the maintenance of the drain pump, it is necessary to open the drain outlet by detaching the drain cap from the drain pan.

Figure 12:
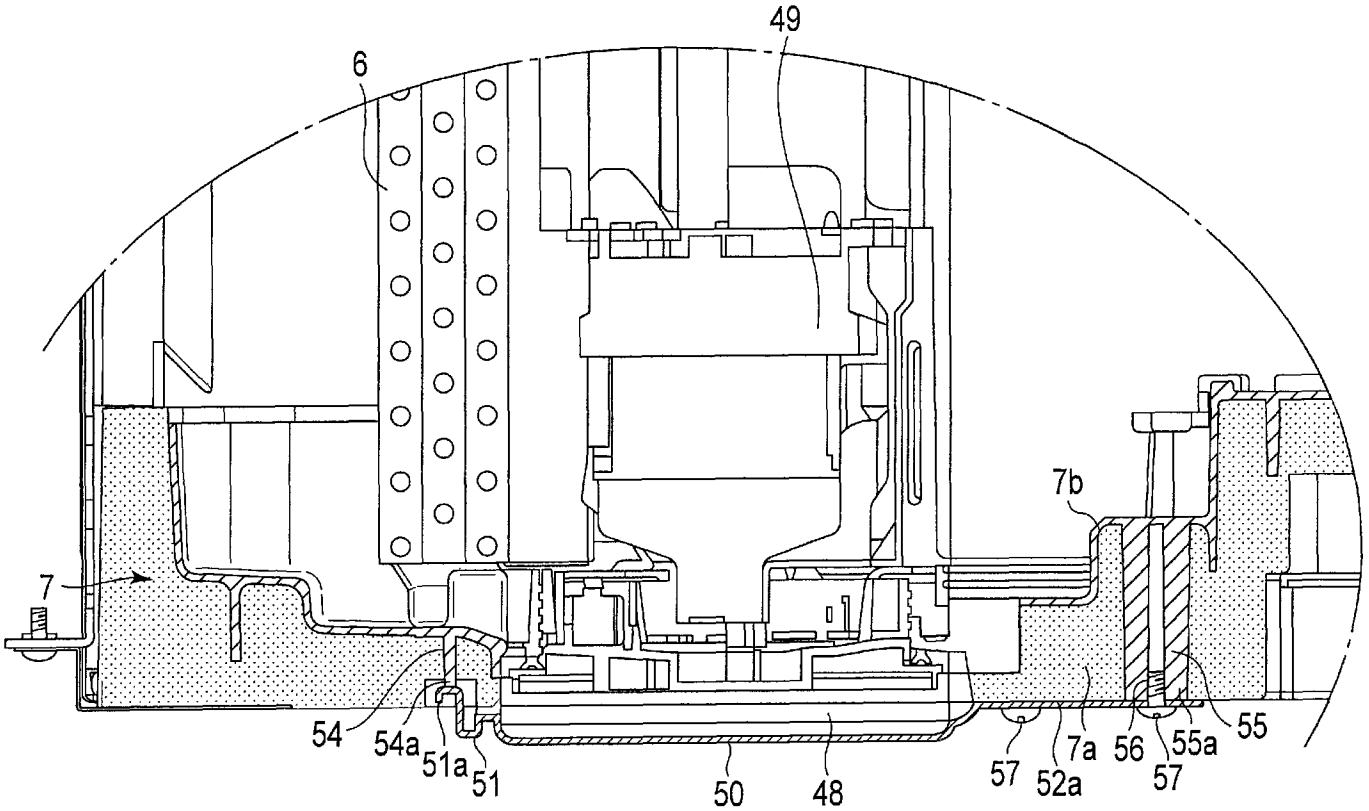
FIG. 12 is a sectional view of the air conditioner showing a state where a drain cap is attached to a drain outlet of the drain pan.

As shown in FIGS. 4 and 12, the drain pan 7 comprises a drain outlet 48 opening in the recess 15. The drain outlet 48 is located directly below the drain pump 49 and is closed with a detachable drain cap 50. FIG. 12 is a sectional diagram showing a state where the drain cap 50 is attached to the drain outlet 48 of the drain pan 7, and FIG. 13 is a perspective diagram showing a state where the drain outlet 48 of the drain pan 7 is closed with the drain cap 50.

Figure 13:
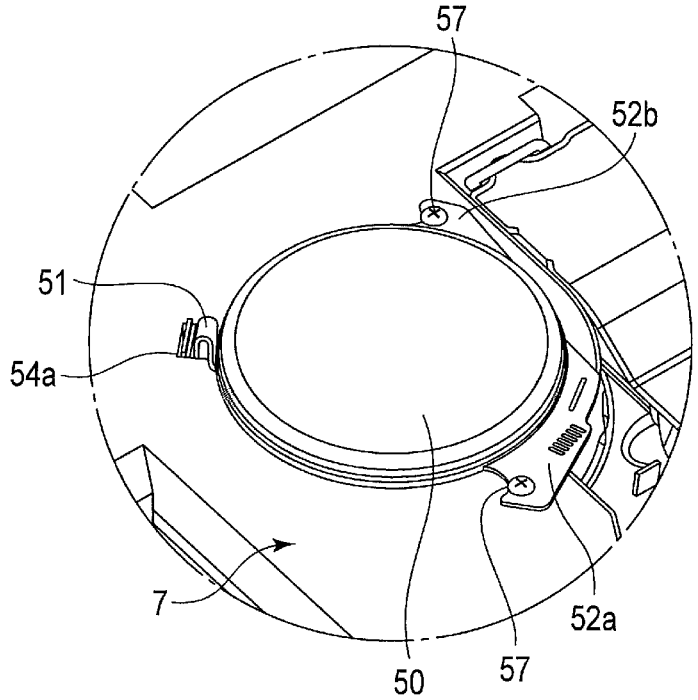
FIG. 13 is a perspective diagram showing a state where the drain outlet of the drain pan is closed with the drain cap.

As shown in FIG. 13, a fixing claw 51 and a pair of tongue-like members 52*a* and 52*b* are integrally formed with the outer circumference of the drain cap 50. The fixing claw 51 and the tongue-like members 52*a* and 52*b* are arranged separately from each other along the circumference of the drain cap 50.

As shown in FIG. 12, the fixing claw 51 projects upward from the outer circumference of the drain cap 50. At the upper end of the fixing claw 51, a claw portion 51*a* where the fixing claw 51 is bent in an arc-like manner is formed. The tongue-like members 52*a* and 52*b* project horizontally from the outer circumference of the drain cap 50. Each of the tongue-like members 52*a* and 52*b* has a slit (not shown) which opens in the outer periphery in a semicircular shape.

As shown in FIG. 12, a first boss 54 and a pair of second bosses 55 (only one of which is shown) are integrally formed with the synthetic resin member 7*b* coating the thermal insulating member 7*a* of the drain pan 7. The first boss 54 and the second bosses 55 project downward from the synthetic resin member 7*b* and penetrate the thermal insulating member 7*a*, respectively.

An end 54*a* of the first boss 54 is exposed to the lower surface of the drain pan 7 in the position corresponding to the fixing claw 51 of the drain cap 50. The claw portion 51*a* of the fixing claw 51 is detachably hooked on the end 54*a* of the first boss portion 54.

At an end 55*a* of each of the second bosses 55, a screw hole 56 is formed. The ends 55*a* of the second bosses 55 are exposed to the lower surface of the drain pan 7 in the positions corresponding to the slits of the tongue-like members 52*a* and 52*b*. The tongue-like members 52*a* and 52*b* are fixed to the second bosses 55 with screws 57. The screws 57 are driven into the screw holes 56 of the second bosses 55 through the slits of the tongue-like members 52*a* and 52*b*.

In the present embodiment, the drain cap 50 is detachably fixed to the drain pan 7 with one fixing claw 51 and two screws 57. Therefore, as compared to the conventional structure for fixing the drain cap 50 to the drain pan 7 with numerous screws, the number of the screw portions can be reduced. Consequently, it is possible to improve the service performance of the attachment or detachment work of the drain cap 50 to or from the drain pan 7.

In the present embodiment, it is preferable that the second bosses 55 should project downward from a position close to the upper surface of the drain pan 7 where the drain water is less likely to be collected. In such a structure, when the ends 55*a* of the second bosses 55 are fixed to the tongues 52*a* and 52*b* of the drain cap 50 with the screws 57, the cold energy of the drain water will be less likely to be transferred to the screws 57 via the second bosses 55, and thus condensation on the heads of the screws 57 can be prevented.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An air conditioner comprising:

a main body incorporating a heat exchanger and installed in a ceiling;

a decorative panel attached to a lower edge of the main body, exposed to a room through the ceiling, and including a discharge port discharging air heat-exchanged in the heat exchanger to the room; and a drain pan including a thermal insulating member and a synthetic resin member and comprising a drain outlet, the synthetic resin member coating the thermal insulating member and being thinner than the thermal insulating member, wherein the drain pan comprises a recess for receiving drain water produced in the heat exchanger, a communication port provided on a periphery of the recess and communicating with the discharge port of the decorative panel, a wall standing between the periphery of the recess and the communication port, and being composed of the synthetic resin member, and a drain cap attached to the drain outlet, and the drain cap comprises a claw and a tongue-like member projecting from a periphery of the drain cap, the synthetic resin member constituting the drain pan comprises a first boss and a second boss penetrating the thermal insulating member, the claw of the drain cap is detachably engaged with an end of the first boss, and the tongue-like member of the drain cap is fixed to the second boss with a screw.

2. The air conditioner of claim 1, wherein the synthetic resin member is a rigid sheet member.

3. The air conditioner of claim 1, wherein the main body comprises a metal casing and a thermal insulating member covering an inner periphery of the casing, the drain pan is fitted in the thermal insulating member of the main body, and the thermal insulating member of the main body faces the wall of the drain pan.

4. The air conditioner of claim 3, wherein the thermal insulating member of the main body constitutes the communication port in conjunction with the wall of the drain pan.

5. The air conditioner of claim 1, wherein the decorative panel comprises a holder temporarily fixing the decorative panel to the main body, and an engagement portion on which the holder is detachably hooked is integrally formed with the synthetic resin member constituting the drain pan.

6. The air conditioner of claim 5, wherein the engagement portion of the drain pan comprises a recess which an end of the holder is inserted into and which includes a pair of sidewalls opposed to each other, and a bridge which bridges between the sidewalls of the recess and which the end of the holder is detachably hooked on.

7. The air conditioner of claim 3, further comprising a fixture fixing the drain pan to the casing, wherein the fixture comprises a first surface fixed to the main body with a screw and a second surface supporting the drain pan from below, and when the screw is loosened, the fixture is rotatable such that the second surface moves away from the drain pan.

8. The air conditioner of claim 7, wherein the first boss of the synthetic resin member constituting the drain pan, which penetrates the thermal insulating member, projects from a lower surface of the drain pan, and the second surface of the fixture comprises an engagement hole engaged with the first boss when the drain pan is supported from below.

9. The air conditioner of claim 8, wherein the casing comprises a metal hanger for hanging the main body, and the hanger is located above the fixture.

* * * * *